US006332929B1

(12) United States Patent
Hartmann et al.

(10) Patent No.: US 6,332,929 B1
(45) Date of Patent: Dec. 25, 2001

(54) METHOD AND DEVICE FOR CLEANING GUIDE ROLLERS IN A WEB-FED ROTARY PRESS

(75) Inventors: Manfred Wolfgang Hartmann, Elfershausen; Horst Bernhard Michalik, Höchberg, both of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/423,662

(22) PCT Filed: May 20, 1998

(86) PCT No.: PCT/DE98/01383

§ 371 Date: Nov. 22, 1999

§ 102(e) Date: Nov. 22, 1999

(87) PCT Pub. No.: WO98/52760

PCT Pub. Date: Nov. 26, 1998

(30) Foreign Application Priority Data

May 21, 1997 (DE) ..... 197 21 213

(51) Int. Cl.[7] ..... B08B 1/00; B08B 1/02

(52) U.S. Cl. ..... 134/6; 134/9; 134/15; 134/18; 134/32

(58) Field of Search ..... 134/6, 9, 15, 18, 134/32

(56) References Cited

U.S. PATENT DOCUMENTS 4,781,116 11/1988 Harada .

FOREIGN PATENT DOCUMENTS

3714143 A1 10/1987 (DE) .
3714143 C2 10/1987 (DE) .
0423093 A2 10/1990 (EP) .
62-132644 6/1987 (JP) .
01031641 2/1989 (JP) .
04-329141 11/1992 (JP) .

*Primary Examiner*—Zeinab El-Arini
(74) *Attorney, Agent, or Firm*—Jones Tullar & Cooper P.C

(57) ABSTRACT

Guide rollers in a web-fed rotary printing press are cleaned by a web of material that is provided with signal information, such as a bar code or a punch code. The retrievable signal information is used by one or more signal reading devices that are used to apply cleaning agent to the web and to create a speed differential between the guide roller and the material web.

10 Claims, 2 Drawing Sheets

METHOD AND DEVICE FOR CLEANING GUIDE ROLLERS IN A WEB-FED ROTARY PRESS

This is a national stage application of PCT/DE98/01383 filed May 20, 1998.

FIELD OF THE INVENTION

The present invention relates to a method and to a device for cleaning guide rollers in a web-fed rotary printing press. A web of material that carries a cleaning agent is provided with coded information. The coded information is detected by a sensor and is used for controlling the cleaning of the guide rollers.

DESCRIPTION OF THE PRIOR ART

A device for cleaning paper guide rollers of a web-fed rotary printing press is known from DE 37 14 143 C2. In this device, a running paper web, which is not being printed upon, is temporarily wetted with a cleaning fluid, which cleaning fluid is then transferred to the paper guide rollers and thereafter is removed, together with any ink remnants removed from the paper guide rollers, by a following portion of the paper web which is not wetted with the solvent. The, paper web has a speed from that of the circumferential speed of the paper guide roller. This difference in speed different is generated by means of drive motors acting on the paper guide roller.

DE 44 27 816 A1 describes a method for the cleaning of cylinders of a sheet-fed rotary printing press. In this device, dirt on the sheets is used for regulating the cleaning.

EP 0423093 A2 discloses a method and a device for cleaning guide rollers in a web-fed rotary printing press. Here, a web of material is wetted with a cleaning agent. The guide rollers are braked for cleaning.

JP-A-01-031641 discloses a device for the cleaning of rollers in a web-fed rotary printing press. Here, the web of material is additionally provided with a cleaning material and the start and end of the cleaning material are detected by means of a sensor for controlling the cleaning process, for example the application of the cleaning material.

SUMMARY OF THE INVENTION

The present invention is based on the object of providing a method, as well as a device for cleaning guide rollers.

This object is attained by the present invention by the provision of a web of material that is provided with coded information, such as a bar code or a punch code. This information is read by a suitable sensor and is used to control the cleaning of the guide rollers in the web-fed rotary printing press.

The advantages which can be obtained by means of the present present invention lie, in particular, in that the guide rollers are cleaned in the course of the passage of the paper web without it being necessary to perform a prior calculation of the path length between the guide rollers of the special paper web course and the storage of this distance in a computer. No paper guide plans need to be prepared. In this way, the braking of those guide rollers, which had not previously been wetted with cleaning fluid, is also avoided, which otherwise could lead to paper web breaks.

BRIEF DESCRIPTION OF THE DRAWINGS

A preferred embodiment of the present invention is represented in the drawings and will be described in greater detail in what follows. Shown are in.

DESCRIPTION OF THE PREFERRED EMBODIMENT

Figure 1:
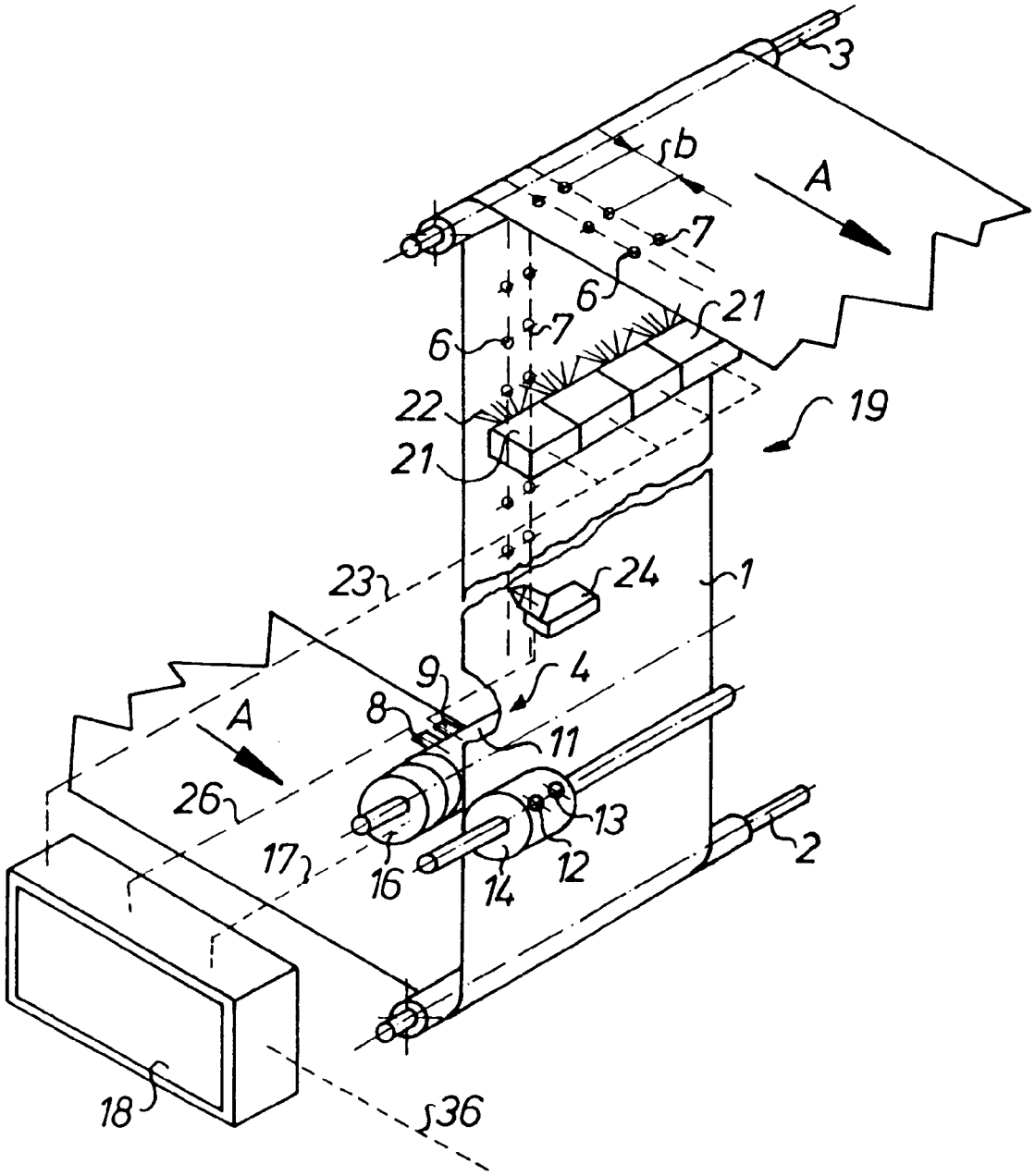
FIG. 1, a schematic perspective representation of a device for the application of information and a device for the application of cleaning fluid to a web of material, and in FIG. 2, a schematic perspective representation of a device acting on the guide roller for generating a speed difference, with a reading device in accordance with the present invention.

A web of material 1, for example a paper web 1, which is located between a roll changer and print units of a web-fed rotary printing press, is guided in the production direction A over rotatable guide roller 2, 3, which are seated fixed in lateral frames, for example, as may be seen in FIG. 1. An output device 4 is arranged between the guide rollers 2, 3. This out put device 4 after it has received a control pulse, puts out a readable information, for example a two-track signal information 6, 7. This information, for example signal information 6, 7, can consist of a punched information, which is cut into the paper web 1 at distances "d" along the paper web 1 by a punch roller 11, which has punches 8, 9 on its circumference, wherein the punch roller 11 works against a punch receiving roller 14, which has holes 12, 13 on the circumference.

These rollers 11, 14 can idle along, driven by friction, or can be driven by a drive, not represented.

The punches 8, 9 of the punch roller 11 can be electrically extended, projecting past the circumference of the punch roller, 11 and can be retracted either individually or together, for example by means of a transmitter 16, which is connected via a line 17 with a control device 18. This transmitter 16 transmits control commands and energy.

The information output device 4 can also apply information 6, 7 to the web 1 of material by means of laser technology.

The information output device 4 in another embodiment, not specifically represented, can also apply bar codes, for example by means of an inkjet printing method.

Viewed in the production direction A, a device 19 for the application of a cleaning agent 22 is arranged after or following the information output device 4 and extends, for example in the form of a nozzle strip, transversely across the width of the paper web. The nozzle strip has nozzles 21, which are placed next to each other and which apply the cleaning agent 22. The nozzles 21 are operated electromagnetically, for example, and are connected with the control device 18 via lines 23.

Another form of a cleaning agent application device 19, not specially represented, for applying cleaning agent 22 can also consist of a fountain roller located in a reservoir and having a doctor blade device and an application roller, which can be placed against the paper web 1.

Viewed in the production direction A, an information reading device 24 is arranged before or ahead of the device 19 for the application of a cleaning agent 22 and is connected via a line 26 with the control device 18, all as may be seen in FIG. 1.

Figure 2:
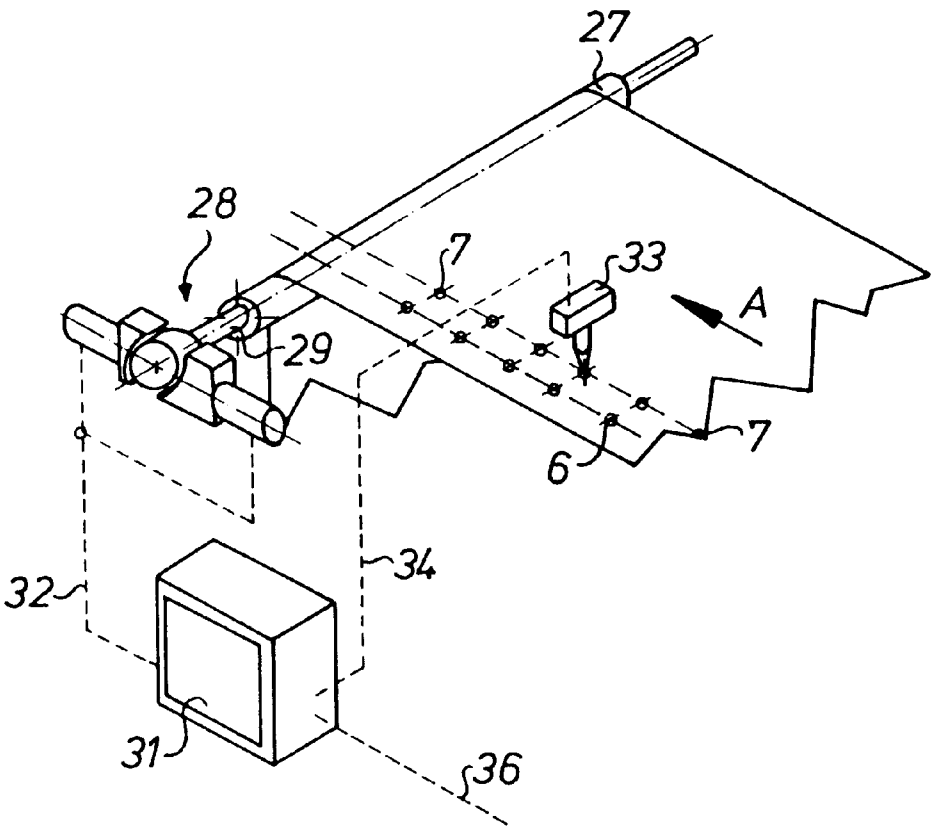

A device 28 for generating a speed difference between the guide rollers 27 and the web 1 of material is assigned to a guide roller 27 or to a group of guide rollers, as is depicted in FIG. 2.

This device 28 can consist of a friction brake, which acts on the guide roller 27, or respectively on its roller journal 29, and can be actuated, for example magnetically, pneumatically or hydraulically, by means of a control device 31 and via a line 32.

In place of a friction brake it is also possible to employ a drive motor, not specially represented, acting on the roller journal 29, and which creates a difference between the circumferential speed of the guide roller 27 and the transport speed of the web 1 of material during the cleaning process.

Viewed in the production direction A, an information reading device 33 is arranged ahead of the speed differential generating device 28 and is connected via a line 34 with a control device 31. The control devices 18, 31 are connected with each other by means of lines 36 and, if required, are also connected with a central computer unit not specifically depicted, as seen in FIG. 2.

In accordance with the invention, the process of cleaning the guide rollers 27 is performed as follows:

The cleaning process is started by a control command entered from a central location, for example a central computer unit. The punches 8, 9 of the punch roller 11 of the output device 4 are extended and cut a two-track signal information 6, 7 into the paper web 1 at a spacing "b", for example 150 mm. The signal information 6 is provided, for example, for putting the cleaning agent application device 19 into operation and for applying cleaning agent, and the signal information 7, is provided for example, for putting the device 28 for generating a speed difference into operation. The signal information 6, for example, determines the position of the cleaning agent 22 on the web 1 of material. The nozzles 21, which apply the cleaning agent 22 on the paper web 1, as seen in FIG. 1 are actuated by the first information reading cleaning device application device 24 of the device 19 for the application of the cleaning agent 22 as a function of the signal information 6. As soon as the signal information 7 reaches second reading device 33 thereafter, the device 28 for generating a speed difference is switched on, and a speed difference between the rotational speed of the surface of the guide roller 27 and the speed of travel of the web 1 of material is created, as depicted in FIG. 2. A maximum speed difference is for example generated, i.e. the guide roller 27 is briefly braked to a stop. Thereafter, the release of the braking device takes place again. This stopping and starting of the guide rollers 27 can be repeated.

In the course of this, cleaning agent 22 is applied to the guide roller 27 and is subsequently removed again; together with the ink remnants, by a section of the paper web 1 which is not wetted with cleaning agent. When the paper web 1 is no longer to be wetted, the signal information 6 which is responsible for spraying is no longer issued.

Each guide roller 27 around and over which the paper web 1 "passes" is cleaned in this way.

The length of time the cleaning agent application device 19, as well as the speed differential generating device 28, are switched on, can be extended after each switch-on pulse triggered by the signal information 6, 7 by means of a time function element.

It is also possible to perform several sequential cleaning cycles.

In a second preferred embodiment, not specially represented, a sensor, for example the second information reading device 33, directly interrogates the cleaning agent 22 on the web 1 of material. This sensor 33 can operate, for example, in accordance with capacitive, optical or moisture-sensitive methods.

Thus, the position of the area of the web 1 of material wetted with cleaning agent 22 is detected by means of this sensor 33.

An output signal of this sensor 33 is used for the control of the cleaning process of the guide roller 27, or of a group of guide rollers. In particular, a speed difference between the rotating speed of the surface of the guide roller 27 and the speed of travel of the web of material is generated as a function of the output signal of this sensor 33.

The section of the web 1 of material used for cleaning preferably is a part of the material to be printed.

While preferred embodiments of a method and device for cleaning guide rollers in a web-fed rotary printing press in accordance with the present invention have been set forth fully and completely hereinabove, it will be apparent to one of skill in the art that a number of changes in, for example the specific roll changer structure, the particular web-fed rotary printing press being used, and the like could be made without departing from the true spirit and scope of the present invention which is accordingly to be limited only by the following claims.

LIST OF REFERENCE NUMERALS

1 Paper web, web of material
2 Guide roller
3 Guide roller
4 Output device
5 -
6 Signal information, information
7 Signal information, information
8 Punch
9 Punch
10 -
11 Roller, first (8, 9)
12 Hole (14)
13 Hole (14)
14 Roller, second (12, 13)
15
16 Transmitter
17 Line
18 Control device
19 Device
20 -
21 Nozzle (19)
22 Cleaning agent
23 Line (21)
24 Reading device
25 -
26 Line (24)
27 Guide roller
28 Device
29 Roller journal (27)
30 -
31 Control device
32 line (28)
33 reading device (28), sensor
34 line (33)
35 -
36 line (18, 31)
A production direction (1)
B spacing (6, 6, 7, 7)

What is claimed is:

1. A method for cleaning guide rollers in a web-fed printing press including:

providing a web of material to be printed in a web-fed rotary printing press;

applying information to said web of material in the form of one of a bar code and a punch code;

providing a cleaning agent application device before, in a production direction, guide rollers to be cleaned;

providing a sensor for detecting said information on said web of material;

using said information on said web of material and detected by said sensor for operating said cleaning agent application device;

applying cleaning agent to said web of material;

passing said web of material over said guide rollers to be cleaned; and cleaning said guide rollers during passage of said web of material carrying said cleaning agent over said guide rollers to be cleaned.

2. The method of claim 1 further including determining a location of said cleaning agent on said web of material using said information.

3. The method of claim 1 further including providing a device for causing a speed differential between said web of material and said guide rollers, and using said information for operating said device for causing a speed differential.

4. The method of claim 3 further including providing a time function element and using said time function element, for controlling a length of time said device for causing a speed differential is actuated.

5. A device for cleaning guide rollers in a web-fed rotary printing press comprising:

a web of material to be printed in a web-fed rotary press;

means for applying information in the form of one of a bar code and a punch code to said web of material;

a reading device for reading said information applied to said web of material;

means for applying a cleaning agent to said web of material in response to said information applied to said web and read by said reading device; and means directing said web of material with said applied cleaning agent past a guide roller to be cleaned.

6. The device of claim 5 further including means for creating a speed differential between said web of material and said guide roller, said means for creating said speed differential being actuated by said reading device.

7. The device of claim 6 wherein said means for creating said speed differential is a friction brake.

8. The device of claim 6 wherein said means for creating said speed differential is a motor brake.

9. The device of claim 5 wherein said means for applying said cleaning agent includes a spray strip having spray nozzles, said spray strip extending transversely to a travel direction of said web of material.

10. The device of claim 5 wherein said means for applying said cleaning agent includes a fountain roller located in a cleaning agent reservoir, a doctor blade in contact with said fountain roller, and an application roller in contact with said fountain roller and moveable into contact with said web of material.

* * * * *